US007118141B2

(12) United States Patent
Cohrs, Jr. et al.

(10) Patent No.: US 7,118,141 B2
(45) Date of Patent: Oct. 10, 2006

(54) APPARATUS AND METHOD FOR SECURING AN EXIT DEVICE TO A DOOR

(75) Inventors: Richard Bettin Cohrs, Jr., New Palestine, IN (US); Eric K. Arthur, Brownsburg, IN (US); Marlin Austin, Speedway, IN (US); Loren D. Mueller, Indianapolis, IN (US)

(73) Assignee: Dor-O-Matic, Inc., Harwood Heights, IL (US)

( * ) Notice: Subject to any disclaimer, the term of this patent is extended or adjusted under 35 U.S.C. 154(b) by 319 days.

(21) Appl. No.: 10/231,657

(22) Filed: Aug. 30, 2002

(65) Prior Publication Data

US 2004/0041411 A1 Mar. 4, 2004

(51) Int. Cl.
*E05B 65/10* (2006.01)

(52) U.S. Cl. ..... 292/92; 292/93; 292/DIG. 53; 292/DIG. 60; 403/43; 403/48

(58) Field of Classification Search ..... 292/92, 292/32, 43, 256.73, 291, DIG. 53, DIG. 54, 292/93, DIG. 60, DIG. 65; 411/21, 63, 64, 411/55; 403/43, 44, 45, 46, 47, 48, 78, 79, 403/300, 301, 302, 303, 306; 74/89.23, 89.28, 74/89.34, 89.45, 424.75
See application file for complete search history.

(56) References Cited

U.S. PATENT DOCUMENTS

| | | | | | |
|---|---|---|---|---|---|
| 145,116 | A | * | 12/1873 | Mckiernan | 403/44 |
| 1,359,391 | A | * | 11/1920 | Landymore | 213/3 |
| 1,891,588 | A | * | 12/1932 | Claus | 410/151 |
| 2,251,031 | A | * | 7/1941 | Boseman | 403/26 |
| 2,479,172 | A | * | 8/1949 | Landon | 403/46 |
| 2,678,226 | A | * | 5/1954 | Wright | 403/46 |
| 2,794,217 | A | * | 6/1957 | Croft | 248/200.1 |
| 2,903,283 | A | * | 9/1959 | Sweetland | 403/78 |
| 3,582,122 | A | | 6/1971 | Foster et al. | |
| 3,614,145 | A | | 10/1971 | Zawadzki | |

(Continued)

FOREIGN PATENT DOCUMENTS

GB 2161201 A * 1/1986

(Continued)

OTHER PUBLICATIONS

Dor-O-Matic 1390 Series Mid-Panel Concealed Vertical Rod Exit Device General information, dated Mar. 1989.

(Continued)

*Primary Examiner*—Brian E. Glessner
*Assistant Examiner*—Carlos Lugo
(74) *Attorney, Agent, or Firm*—Michael Best & Friedrich LLP

(57) ABSTRACT

A securing mechanism for coupling an exit device to a door. The securing mechanism comprises a bracket coupled to the exit device and a shaft having a first end and a second end and defining a longitudinal axis. The bracket defines a first aperture and a second aperture. The first end of the shaft extends through the first aperture and the second end of the shaft extends through the second aperture. The securing mechanism also comprises a first anchor slideably coupled to the shaft and moveable along the longitudinal axis between a first locked position and a first unlocked position and a second anchor slideably coupled to the shaft and moveable along the longitudinal axis between a second locked position and a second unlocked position. The first anchor frictionally engages the door in the first locked position and the second anchor frictionally engages the door in the second locked position.

25 Claims, 8 Drawing Sheets

U.S. PATENT DOCUMENTS 3,643,478 A * 2/1972 McPeake ..... 70/212
3,663,047 A 5/1972 Zawadzki
3,730,574 A 5/1973 Zawadzki
3,767,238 A 10/1973 Zawadzki
3,854,763 A 12/1974 Zawadzki et al.
3,913,263 A * 10/1975 Butt ..... 49/16
3,923,220 A * 12/1975 Marcyan ..... 224/547
4,081,219 A * 3/1978 Dykmans ..... 403/43
4,083,590 A 4/1978 Folger
4,130,269 A * 12/1978 Schreyer ..... 403/45
4,167,280 A 9/1979 Godec et al.
4,225,163 A 9/1980 Hubbard et al.
4,340,196 A * 7/1982 Eldred ..... 244/1 R
4,368,905 A * 1/1983 Hirschbein ..... 292/5
4,458,928 A 7/1984 Hirschbein
4,488,378 A 12/1984 Symon
4,560,192 A * 12/1985 Wilson et al. ..... 292/339
4,601,499 A * 7/1986 Kim ..... 292/36
4,624,120 A 11/1986 Hoffman et al.
4,677,814 A * 7/1987 Anderson et al. ..... 56/15.6
D295,606 S * 5/1988 Ault ..... D8/330
4,741,563 A 5/1988 Cohrs
4,799,422 A * 1/1989 Birt ..... 454/131
4,836,485 A * 6/1989 Cooper ..... 248/278.1
4,839,988 A 6/1989 Betts et al.
5,011,199 A 4/1991 Lowe et al.
5,018,690 A * 5/1991 Widmer ..... 246/428
5,031,945 A 7/1991 Toledo
5,042,851 A * 8/1991 Hunt ..... 292/21
5,042,852 A 8/1991 Vitt et al.
5,067,757 A 11/1991 Cohrs et al.
5,085,475 A 2/1992 Austin et al.
5,114,192 A 5/1992 Toledo et al.
5,154,454 A * 10/1992 Hollaway ..... 292/21
5,340,095 A * 8/1994 Eicher, III ..... 269/43
5,364,140 A * 11/1994 Rice ..... 292/259 R
5,372,394 A 12/1994 Salter et al.
5,412,961 A 5/1995 Cain et al.
5,464,259 A 11/1995 Cohrs et al.
5,609,371 A 3/1997 Mader et al.
5,639,129 A * 6/1997 Lindley ..... 292/145
5,673,883 A * 10/1997 Figueroa, Jr. ..... 248/200.1
5,673,949 A 10/1997 Mader et al.
5,682,778 A 11/1997 Cohrs et al.
5,762,385 A 6/1998 Mader et al.
5,765,957 A * 6/1998 Connell ..... 403/46
5,904,384 A 5/1999 Mader et al.
5,927,765 A 7/1999 Austin et al.
D425,810 S 5/2000 Siller et al.
6,076,384 A * 6/2000 Thielmann et al. ..... 70/210
D430,786 S 9/2000 Hickman et al.
D433,307 S 11/2000 Hickman et al.
D434,339 S 11/2000 Siller et al.
6,205,825 B1 * 3/2001 Haeck et al. ..... 70/92
6,233,877 B1 * 5/2001 Monroe ..... 52/37
6,304,177 B1 10/2001 Nigro, Jr. et al.
D451,359 S 12/2001 DePass
6,409,232 B1 6/2002 Nigro, Jr. et al.
6,485,066 B1 11/2002 Nigro, Jr. et al.
6,609,575 B1 * 8/2003 Crabb ..... 172/439
6,619,708 B1 * 9/2003 Naylor ..... 292/259 R

FOREIGN PATENT DOCUMENTS

GB 2245326 A * 1/1992
JP 10339059 A * 12/1998

OTHER PUBLICATIONS

NT Dor-O-Matic Greendale 1390 Mid-Panel Exit Device Parts List, Field Disassembly, and Reassembly Manual "Front Load", dated Jan. 1997.
Kawneer Installation Paneline/Panic Guard Exit Device Service & Adjustment Instructions, dated Feb. 1997.
Dor-O-Matic Exit Device Condensed Catalog, pp. 1-6, dated Feb. 2002.
Von Duprin Inpact 94 and 95 Series Exit Devices with a copyright date of 2000.

* cited by examiner 12
16
20
30
32
24
28
156
26
37
156
157
36
30
14
40
22
25
25

APPARATUS AND METHOD FOR SECURING AN EXIT DEVICE TO A DOOR

FIELD OF THE INVENTION

The present invention relates generally to fasteners and fastening apparatuses, and more particularly to a method and apparatus for coupling an exit device to the middle panel or midrail of a door.

BACKGROUND OF THE INVENTION

A variety of exit devices are commonly used for operating and opening doors. Generally, exit devices include a latching mechanism having a bolt or bolts, which secure the door to a doorframe to lock the door in a closed position. By activating the exit device, a user can retract the bolt from the doorframe and open the door. Commonly, exit devices are installed in doors located in commercial and public buildings and therefore are designed to be operated by a large number and variety of people, including children, the elderly, and the disabled. Therefore, exit devices that are easy to operate and require minimal strength and skill to operate are highly desirable. Additionally, exit devices are often designed to facilitate rapid building egress, such as, for example, during a fire, a natural disaster, or other similar emergency. Exit devices commonly include readily accessible actuators for use in an emergency by panicked or scared people.

Moreover, exit devices are often located on the fronts of buildings and in business entryways. It is therefore desirable that the exit devices be aesthetically pleasing and not detract from the appearance of the door or the building. Typically, exit devices are secured to doors using fasteners, including bolts, nuts, screws, and the like. Additionally, custom designed mounting brackets, rails, and the like are often installed on the doors. In some cases, the fasteners and mounting brackets can be unsightly. It is therefore desirable to minimize the number of fasteners and mounting brackets used and to locate the fasteners and mounting brackets in unobtrusive places on the door and the exit device.

Generally, exit devices are purchased separately from the doors and are installed in doors as the doors are being mounted in their respective doorframes. During installation, holes are generally drilled in the door and in the exit device to accommodate the fasteners. To properly mount the exit devices, the holes must be precisely located and threaded. The fasteners and mounting brackets are typically separate from the exit device and consequently are easily misplaced or lost during the installation and shipping processes. Moreover, in some cases the doors must be at least partially disassembled before the exit device can be properly installed.

In addition to the above mentioned design considerations, exit devices that are durable, easy to manufacture, easy to assemble, and inexpensive are highly desirable for obvious reasons.

SUMMARY OF THE INVENTION

According to the present invention, a securing mechanism for coupling an exit device to a door includes a shaft having a first end and a second end and defining a longitudinal axis. A bracket is coupled to the exit device and defines a first aperture and a second aperture. The first end of the shaft extends through the first aperture and the second end of the shaft extends through the second aperture. A first anchor is slideably coupled to the shaft and is moveable along the longitudinal axis between a first locked position and a first unlocked position. The first anchor frictionally engages the door in the first locked position. A second anchor is slideably coupled to the shaft and is moveable along the longitudinal axis between a second locked position and a second unlocked position. The second anchor frictionally engages the door in the second locked position.

In some embodiments of the securing mechanism the first anchor and the second anchor are threadably coupled to the shaft. The first end is threaded in a first direction and the second end is threaded in a second opposite direction. A threaded fastener is movable along the shaft. The threaded fastener is operable to secure the first anchor in the first locked position and the second anchor in the second locked position.

The bracket matingly engages the first and second anchors substantially preventing the first anchor and second anchor from rotating about the longitudinal axis with respect to the door. The first anchor includes a first plurality of axially extending protrusions. The first plurality of axially extending protrusions matingly engages the door when the first anchor is in the first locked position. The second anchor includes a second plurality of axially extending protrusions. The second plurality of axially extending protrusions matingly engages the door when the second anchor is in the second locked position.

The shaft includes at least one flat face extending longitudinally along the longitudinal axis. A shoulder extends radially from the shaft. The shoulder limits the sliding movement of the first anchor and the second anchor along the longitudinal axis. The door includes a midrail defining a recess and the exit device is positioned in the recess.

The present invention also includes a method of coupling the exit device to a door with a securing mechanism. The method comprises coupling the bracket to the exit device, rotating the shaft in a first direction about the longitudinal axis, moving the first anchor along the shaft toward the first end, moving the second anchor along the shaft toward the second end, and applying a compressive force to the door with the first and second anchors to hold the exit device and the securing mechanism in the door.

Additional features and advantages of the invention will become apparent to those skilled in the art upon consideration of the following detailed description, claims, and drawings.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION

Figure 1:
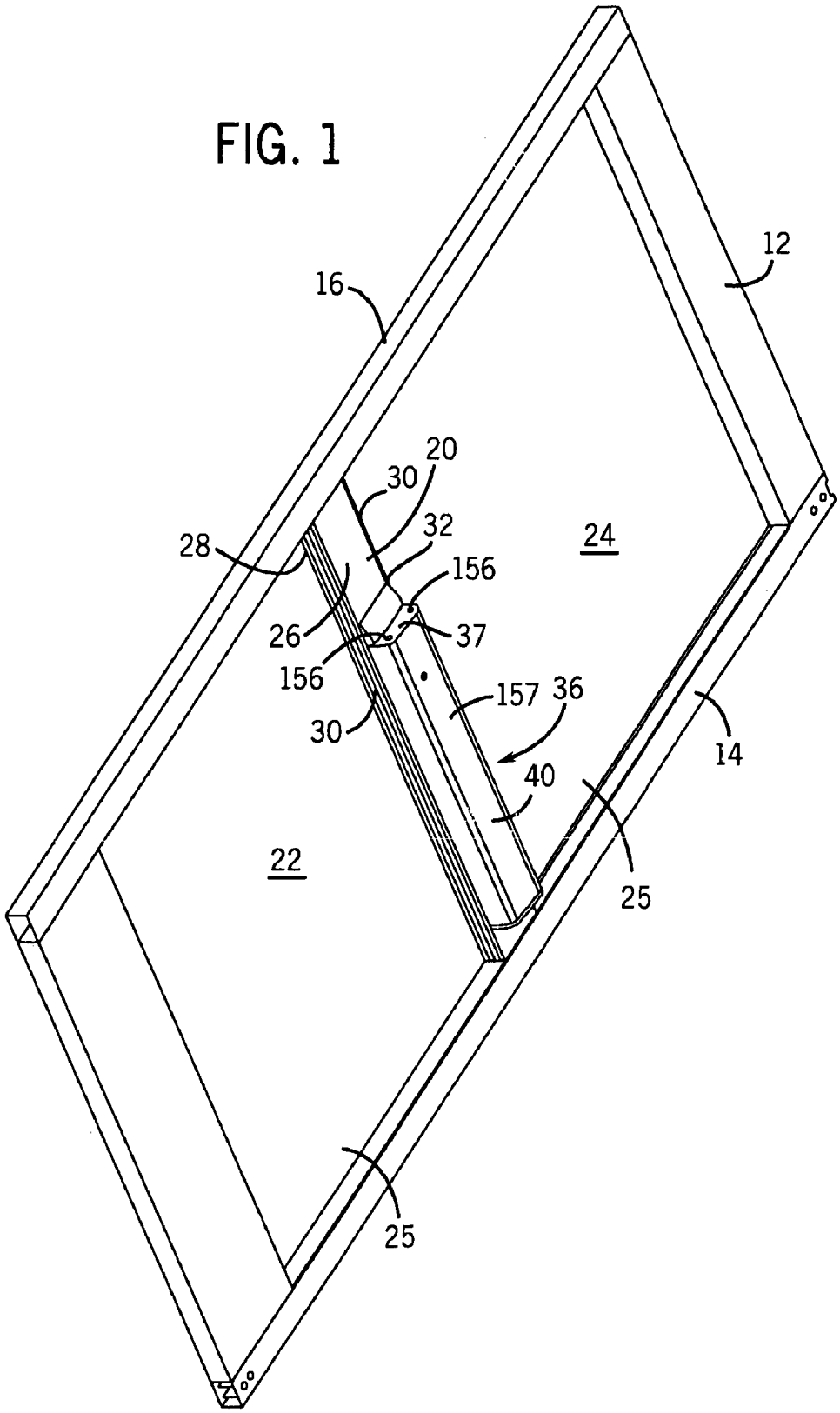
FIG. 1 is a perspective view of a door having an exit device and securing mechanisms embodying the present invention.
Figure 2:
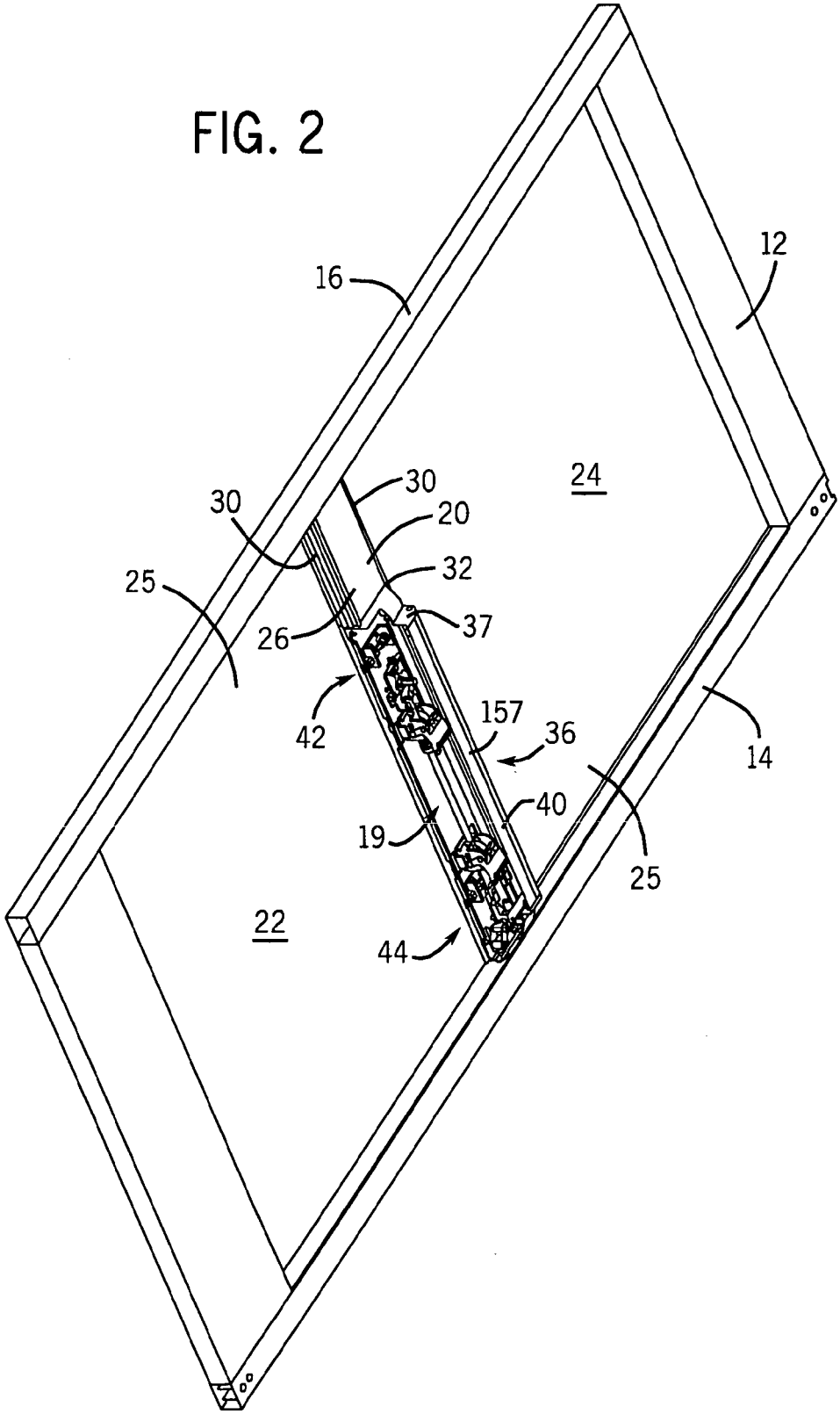
FIG. 2 is a perspective view, with parts broken away, of the exit device and the securing mechanisms of FIG. 1.

FIGS. 1 and 2 illustrate a door 12 including an active stile 14 positioned at one side and an inactive stile 16 positioned at the other side. Hinges (not shown) pivotably couple the inactive stile 16 to a doorframe (not shown). The active stile 14 includes a latching mechanism 19, which when the door 12 is in a latched position, extends into the doorframe and secures the door 12 in the doorframe in a closed or latched position. To open the door, the latching mechanism 19 is retracted back into the active stile 14 so that the door 12 can be pivoted about the hinges to an open position.

A midrail 20 extends between the inactive stile 16 and the active stile 14 and divides the door 12 into a lower portion 22 and an upper portion 24. In the illustrated embodiment, the lower and upper portions 22, 24 include transparent glass panels 25. However, one having ordinary skill in the art will appreciate that other materials commonly used in doors, including opaque and translucent materials, such as, for example, wood, steel, aluminum, and the like can also or alternately be used. Additionally, the term "midrail" as used herein and in the appended claims is meant to be illustrative and is not meant to indicate placement of the midrail 20 with respect to the door 12. Also, the midrail 20 can, but does not necessarily, divide the door 12 into equally sized upper and lower portions 22, 24.

Figure 3:
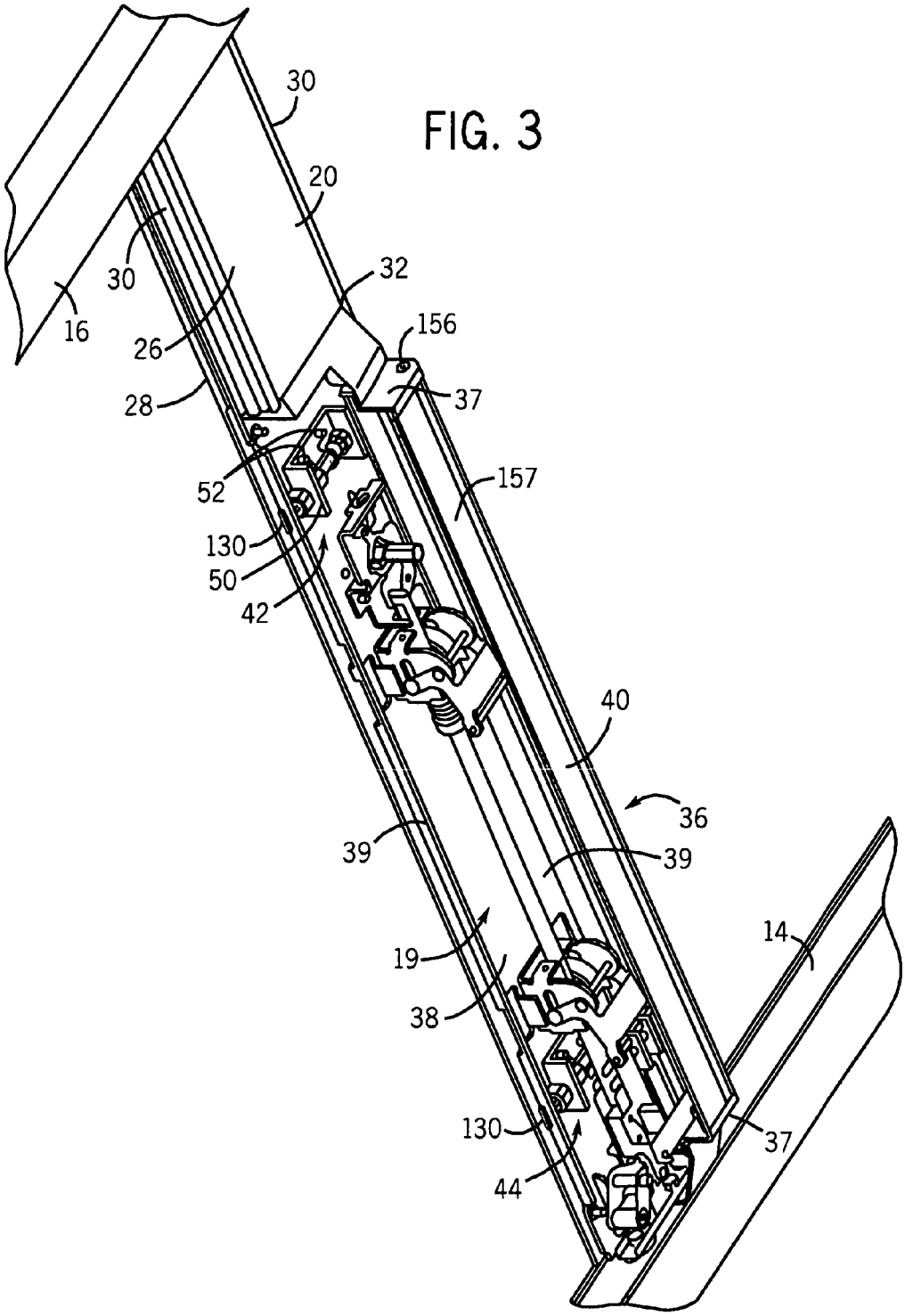
FIG. 3 is an enlarged perspective view, with parts broken away, of the exit device and the securing mechanisms of FIG. 2.
Figure 4:
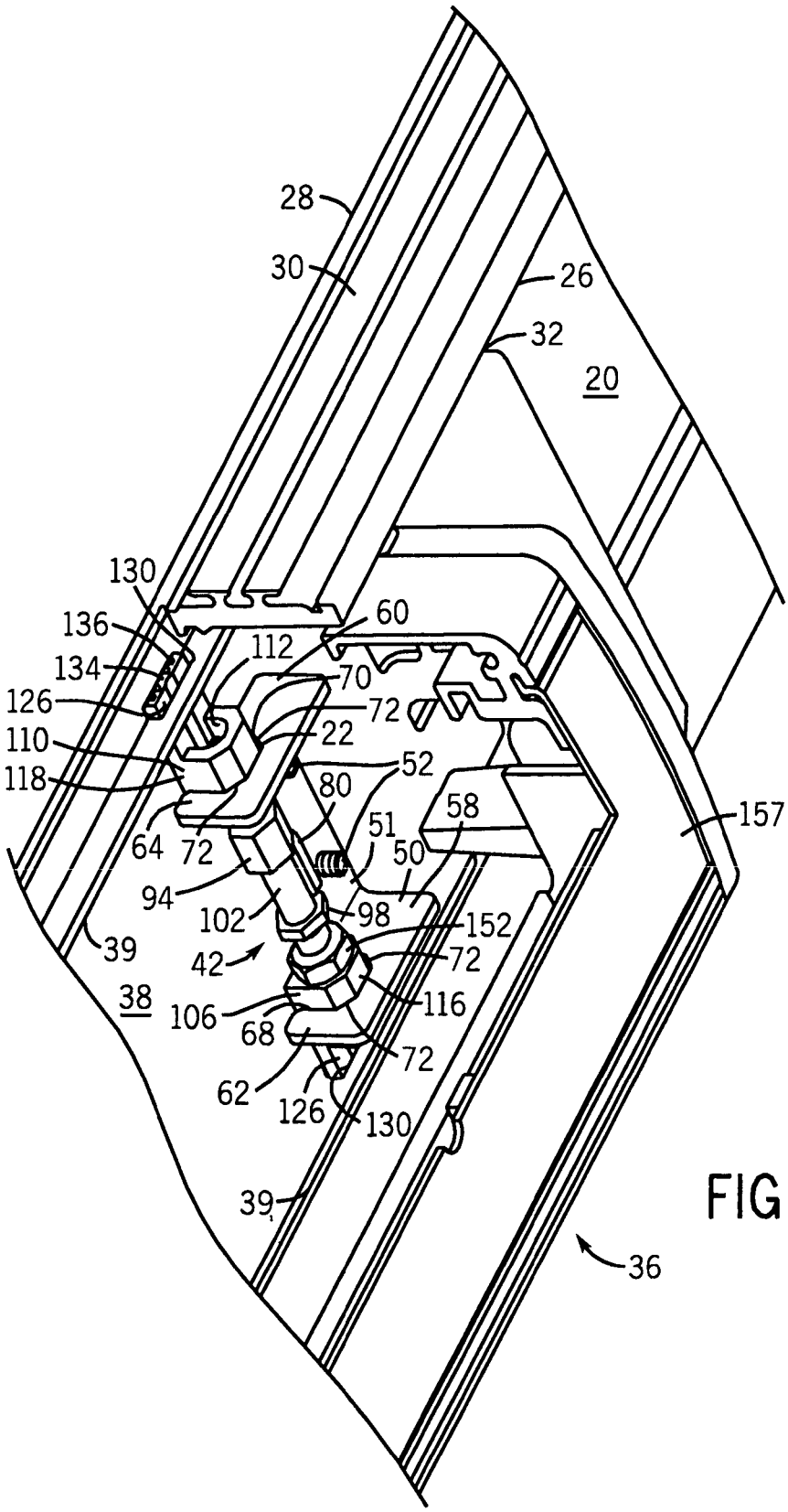
FIG. 4 is an enlarged perspective view, with parts broken away, of one of the securing mechanisms of FIG. 3.

Referring to FIG. 3, the midrail 20 includes a front 26, a back 28, and a pair of sides 30 generally perpendicular to the front and back 26, 28. Together, the sides 30 and the back 28 define a cutout or recessed portion 32, which extends into the midrail 20. An exit device 36 is located in the recessed portion 32 and includes sides 37, a base plate 38 that is perpendicular to the sides 37 and rests against the back 28, and a push bar 40, which is spaced apart and is generally parallel to the base plate 38. Rails 39 extend laterally along the sides of the base plate 38 adjacent to the sides 30 of the midrail 20 and operate to provide stability and rigidity to the base plate 38. One having ordinary skill in the art will appreciate that in some applications other strengthening elements can also or alternately be used. Similarly, in some applications, particularly in applications in which the exit device 36 is relatively short and lightweight, the exit device 36 can operate without rails 39. In operation, the push bar 40 is depressed inwardly toward the back 28 by a user to disengage the latching mechanism 19 from the doorframe in a known manner.

Generally, exit devices 36 and doors 12 are sold separately and are assembled on location, immediately prior to or during door installation. To facilitate installation in a number of doors 12 having a number of different shapes and configurations, the exit device 36 includes securing mechanisms 42, 44. Preferably, the securing mechanisms 42, 44 are coupled to the base plate 38 during assembly of the exit device 36, as described in greater detail below. Therefore, the exit device 36 and the securing mechanisms 42, 44 can be supplied to builders and contractors as modular units, which can be installed relatively easily in midrails 20 at job sites with minimal effort and with a minimal number of tools. Moreover, as explained in more detail below, the inclusion of the securing mechanisms 42, 44 in the exit device 36 simplifies the installation of the exit devices 36 in doors 12 and preferably alleviates the need to drill unsightly holes in midrails 20 and to thread unsightly bolts and fasteners through the midrails 20 and the exit device 36.

In the illustrated embodiment, two securing mechanisms 42, 44 are coupled to the base plate 38. As shown in FIGS. 2 and 3, the first securing mechanism 42 is coupled to a first end of the base plate 38 and the second securing mechanism 44 is coupled to a second opposite end of the base plate 38. One having ordinary skill in the art will appreciate that in other embodiments, one, three, four, or more securing mechanisms 42, 44 can be spaced along the base plate 38, depending, at least in part, upon the width of the door 12, the length of the midrail 20, and the size and weight of the exit device 36.

The securing mechanisms 42, 44 are substantially similar. Therefore, for purposes of description, one securing mechanism 42 is described in detail hereafter. Referring now to FIGS. 3–8, the securing mechanism 42 includes a U-shaped bracket 50, having a relatively horizontal center section 51. The securing mechanism 42 is fixedly coupled to the base plate 38 with threaded fasteners 52 that extend through apertures 54 in the center section 51. The fasteners 52 permanently or nearly permanently couple the U-shaped bracket 50 to the base plate 38. In other embodiments, other conventional fasteners 52 could also or alternatively be used, including pins, rivets, nails, bolts, adhesives, keys, and the like. Alternatively or in addition, the U-shaped bracket 50 can be welded to the base plate 38.

The bracket 50 includes a first leg 58 and a second leg 60. The first and second legs 58, 60 are perpendicular to and extend outwardly from the central section 51. The first and second legs 58, 60 include generally L-shaped hooks or arms 62, 64, respectively. The L-shaped arms 62, 64 extend away from the first and second legs 58, 60 in a direction substantially parallel to the base plate 38, and then extend downward toward the base plate 38. The first leg 58, together with the L-shaped arm 62 and the base plate 38, define a generally U-shaped first aperture 68. Similarly, the second leg 60, the L-shaped arm 64, and the base plate 38 define a generally U-shaped second aperture 70. Additionally, chamfers 72 extend through the first and second legs 58, 60 and the L-shaped arms 62, 64, forming two substantially flat edges on the periphery of each of the first and second apertures 68, 70. A longitudinal axis 76 (shown in FIG. 5) extends parallel to the central section 51 through the first and second apertures 68, 70. The bracket 50 also includes a tab or tongue 80 that extends outwardly from the central section 51 between first and second legs 58, 60, and then curves upwardly away from the base plate 38 in a direction substantially perpendicular to the central axis 76.

Figure 6:
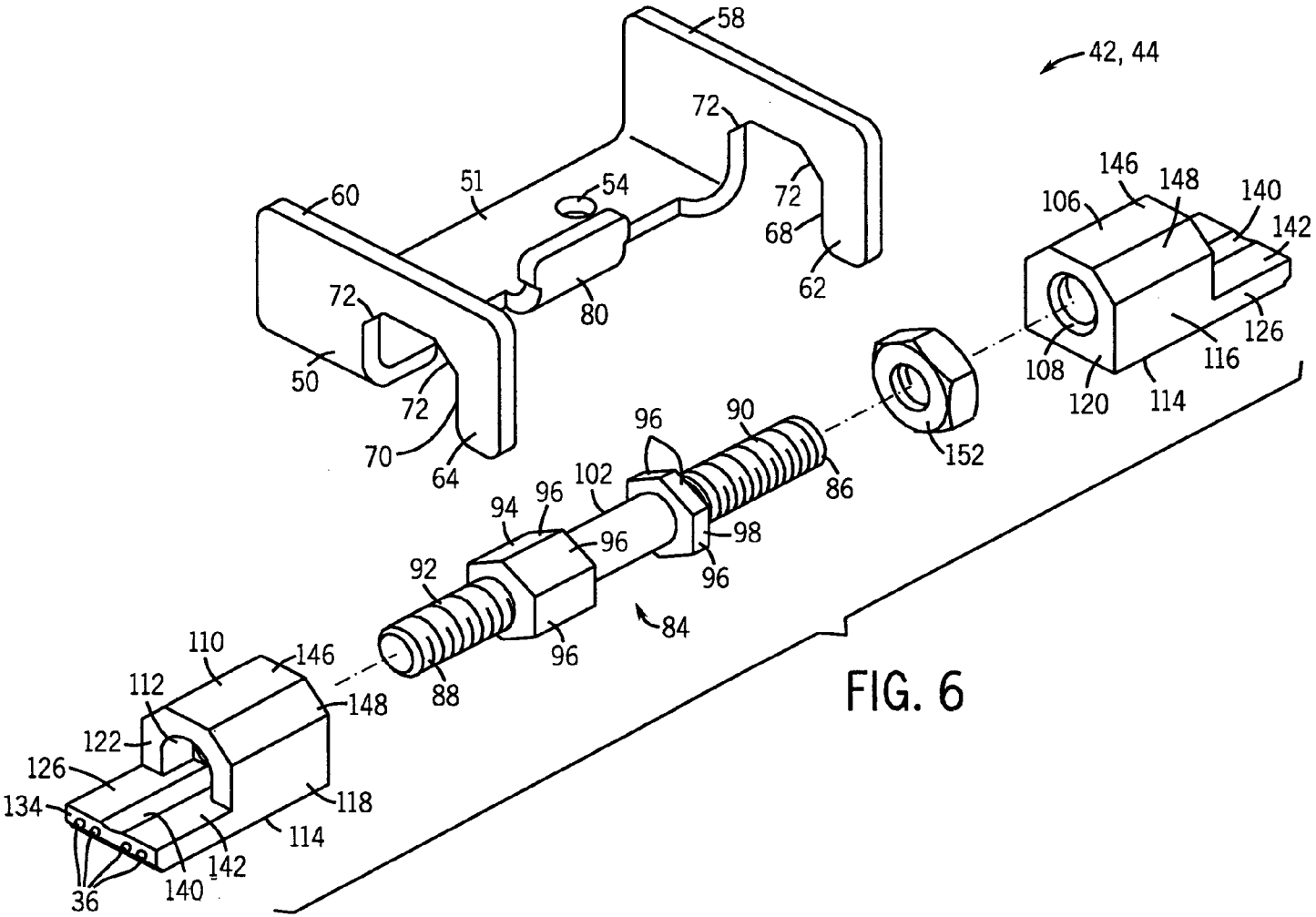
FIG. 6 is an exploded perspective view of one of the securing mechanism of FIG. 5.
Figure 7:
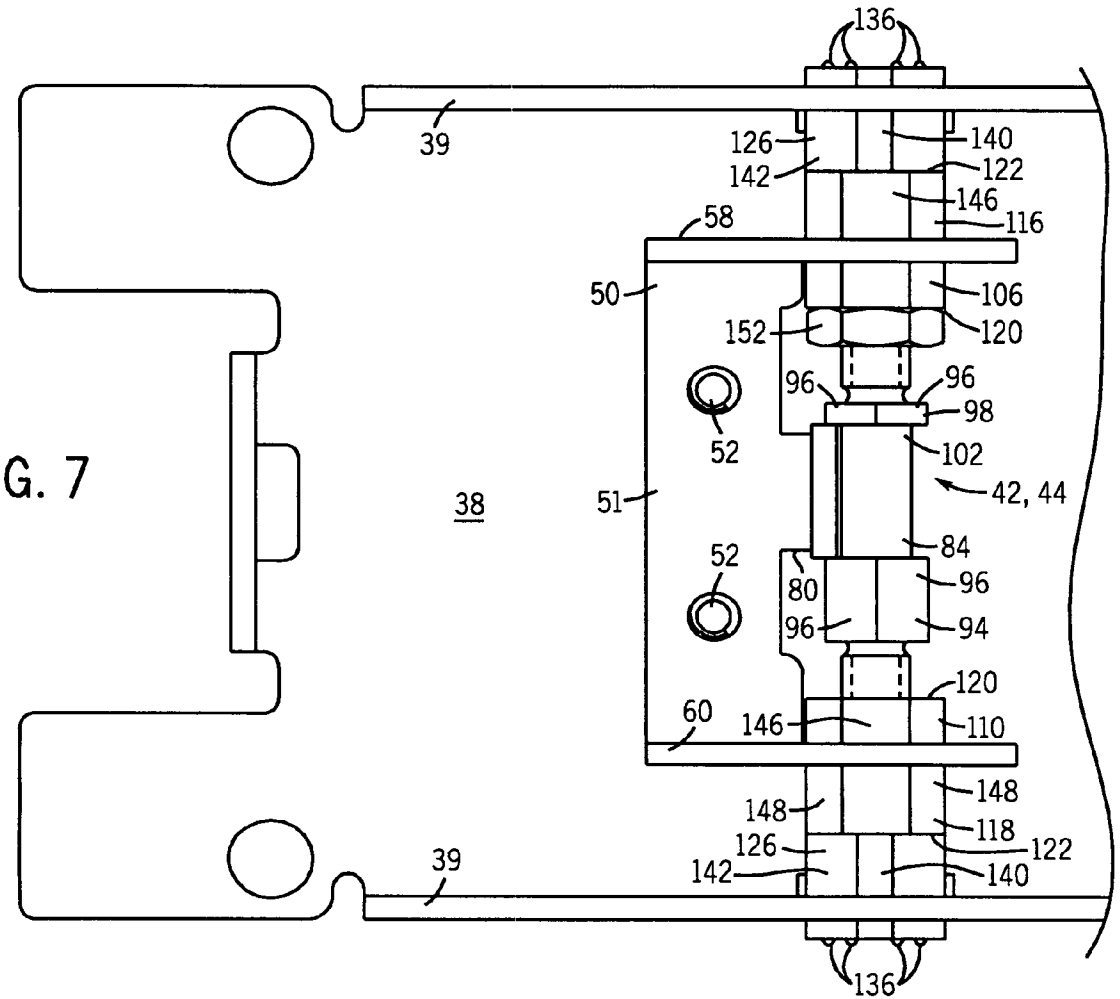
FIG. 7 is a plan view of the securing mechanism of FIG. 5.
Figure 8:
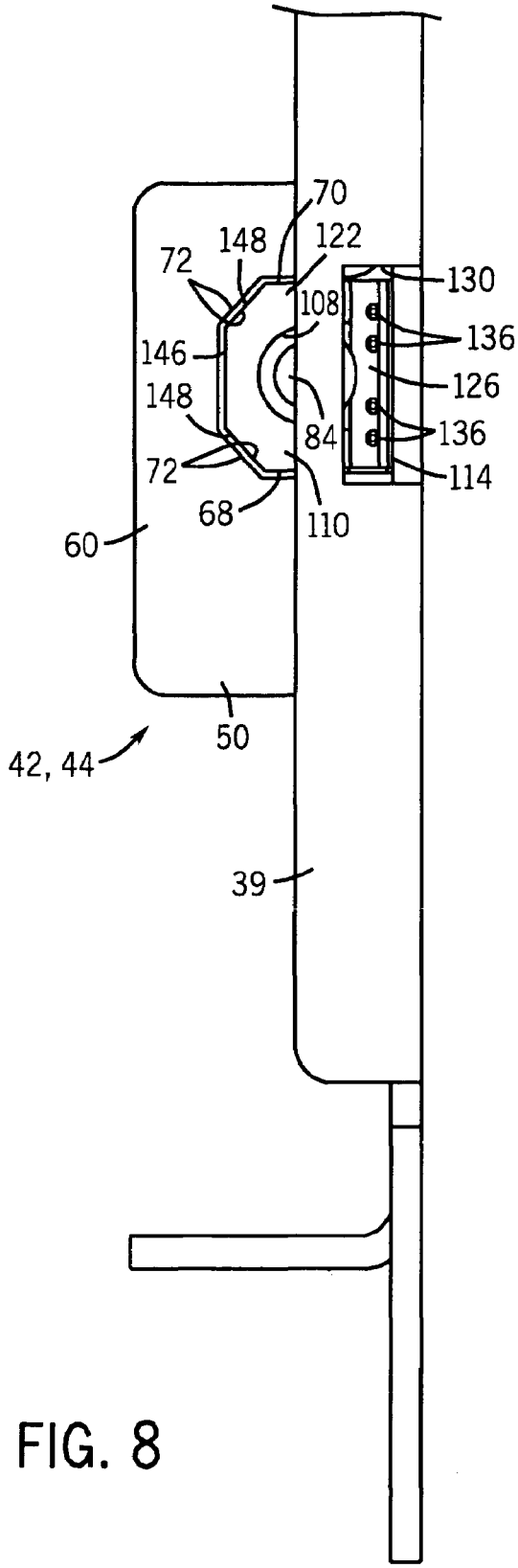
FIG. 8 is a side view of the securing mechanism of FIG. 5.

With reference to FIG. 6, a shaft 84 having a first end 86 and a second end 88 is coaxial with the longitudinal axis 76 and against tab 80. The first end 86 extends through the first aperture 68 and the second end 88 extends through the second aperture 70. The first and second ends 86, 88 are threaded in opposite directions. In the illustrated embodiment, the first end 86 includes right-hand threading 90 and the second end 88 includes left-hand threading 92. However, one having ordinary skill in the art will appreciate that in other embodiments the first end 86 can include left-hand threading and the second end 88 can include right-hand threading.

The shaft 84 includes a first operator 94, which is located between the first and second ends 86, 88. The first operator 94 includes one or more flat surfaces 96 so that a wrench (not shown) or another similar tool can easily grasp and turn the shaft 84 about the longitudinal axis 76. In the illustrated embodiment, the first operator 94 is integrally formed with the shaft 84 and includes six flat surfaces 96. In this manner, a conventional open-end wrench can be used to turn the first operator 94. However, one having ordinary skill in the art will appreciate that in other embodiments the first operator 94 can include any number of flat surfaces 96 and can be engaged by any number of tools, including spanner wrenches and the like. Similarly, in other embodiments, recesses or protrusions can be machined into or extend from the first operator 94 respectively to facilitate engagement with other tools.

The shaft 84 also includes a second operator 98, which is substantially similar to and adjacent the first operator 94. The second operator 98 also includes flat surfaces 96 and can be rotated with a tool about the longitudinal axis 76. In the illustrated embodiment, the first and second operators 94, 98 are similarly sized and include the same number of flat surfaces 96 so that a single tool (e.g., a 7/16" wrench) can be used to rotate both the first and second operators 94, 98. However, in other embodiments, the first and second operators 94, 98 can be differently sized and can include different numbers and arrangements of flat surfaces 96 so that a user could use either of two different tools to rotate the shaft 84 about the longitudinal axis 76.

A central section 102 of the shaft 84 extends between the first and second operators 94, 98 and has a relatively small diameter. The first and second operators 94, 98 operate as shoulders and serve to hold the central section 102 against the tab 80. Additionally, the first and second operators 94, 98 ensure that the shaft 84 remains in the correct position relative to the base plate 38 during operation of the exit device 36.

A first or right hand anchor 106 having a centrally located internally threaded through bore 108 is threaded onto the first end 86 of the shaft 84 and a second or left hand anchor 110 having a centrally located internally threaded through bore 112 is threaded onto the second end 88 of the shaft 84. In the illustrated embodiment, through bore 108 includes right-hand threading and through bore 112 includes left-hand threading. However, as discussed above with respect to the threading of the shaft 84, in other embodiments through bore 108 can include left-hand threading and through bore 112 can include right-hand threading.

During operation, the first and second anchors 106, 110 move axially along the shaft 84 and bases 114 of the anchors 106, 110 slide along the base plate 38. The first and second operators 94, 98 act as stops, limiting the movement of the first and second anchors 106, 110 along the shaft 84 and preventing the first and second anchors 106, 110 from moving onto the unthreaded central section 102 of the shaft 84.

The first and second anchors 106, 110 include blocks 116, 118, respectively. The blocks 116, 118 have interior sides 120 facing inwardly toward the first and second operators 94, 98 and exterior sides 122 facing outwardly toward the sides 30 of the midrail 20. Lips 126 extend laterally from the exterior sides 122 through appropriately sized apertures 130 (shown in FIG. 4) in the rails 39 toward the sides 30 of the midrail 20. The lips 126 have a low profile and therefore do not interfere with the operation of the exit device 36 when the first and second anchors 106, 110 move outwardly toward the sides 30 of the midrail 20. More particularly, the low profile allows the lips 126 to move laterally without contacting the push bar 40 when the push bar 40 is depressed. Additionally, the low profile of the lips 126 alleviates the need to include cutouts in the push bar 40 to accommodate the movement of the first and second anchors 106, 110. This is particularly advantageous because the inclusion of these cutouts would necessitate an additional machining operation. Moreover, these cutouts would act as pinch points and would weaken the push bar 40. Referring back to FIG. 4, exterior surfaces 134 of the lips 126 include a plurality of conical protrusions 136, best seen in FIG. 5. Channels 140 extend laterally along upper surfaces 142 of the lips 126. The channels 140 extend into the through bores 108, 112 and accommodate the shaft 84.

Upper surfaces 146 of the first and second blocks 116, 118 include flat sides 148, which are sized and angled to closely mate with the chamfers 72. In this manner, the first and second anchors 106, 110 can move laterally along the longitudinal axis 76 through the first and second apertures 68, 70 but are prevented from moving perpendicular to the longitudinal axis 76 by the first and second legs 62, 64, respectively. Additionally, the mating relationship between the flat sides 148 and the flat edges 72 simplifies assembly of the securing mechanism 42 and ensures that the first and second anchors 106, 110 are positioned correctly with respect to the bracket 50 during assembly of the securing mechanism 42.

A lock nut 152 is threaded onto the shaft 84 between the second operator 98 and the first anchor 106. In the illustrated embodiment, the lock nut 152 is a commercially available 7/16" hex jam nut. In alternative embodiments of the present invention other fasteners, including threaded and non-threaded fasteners, such as, for example, lock washers, pins, and the like can also or alternatively be used. Similarly, one having ordinary skill in the art will appreciate that the lock nut 152 could also or alternately be positioned between the first operator 94 and the second anchor 110. In the illustrated embodiment, the lock nut 152 is not the same size as the first and second operators 94, 98. However, one having ordinary skill in the art will appreciate that the lock nut 152 and the first and second operators 94, 98 can be the same size so that a single wrench can be used to tighten or loosen the lock nut 152 and the first and second operators 94, 98.

The present invention as described herein and as shown in the figures includes a single lock nut 152 positioned between the first anchor 106 and the second operator 98. However, one having ordinary skill in the art will appreciate that the present invention could also include a second lock nut 152 positioned between the second anchor 110 and the first operator 94.

The present invention also includes a method for installing the exit device 36 in the door 12 using securing mechanisms 42, 44. As mentioned above, the exit device 36 is inserted into the cutout 32 in the midrail 20. The installer then removes fasteners 156 (shown in FIG. 1), which hold the sides 37 on the exit device 36. One or both of the sides 37 is then removed. A removable portion 157 of the push bar 40 is then removed laterally toward the open end of the exit device 36. The installer can then gain access to the securing mechanisms 42, 44.

Prior to installation, the first and second anchors 106, 110 are preferably in a retracted position. In the retracted position, the interior sides 120 of the blocks 116, 118 are preferably adjacent to the first and second operators 94, 98, respectively. Additionally, the lock nut 152 is preferably adjacent the second operator 98.

Figure 5:
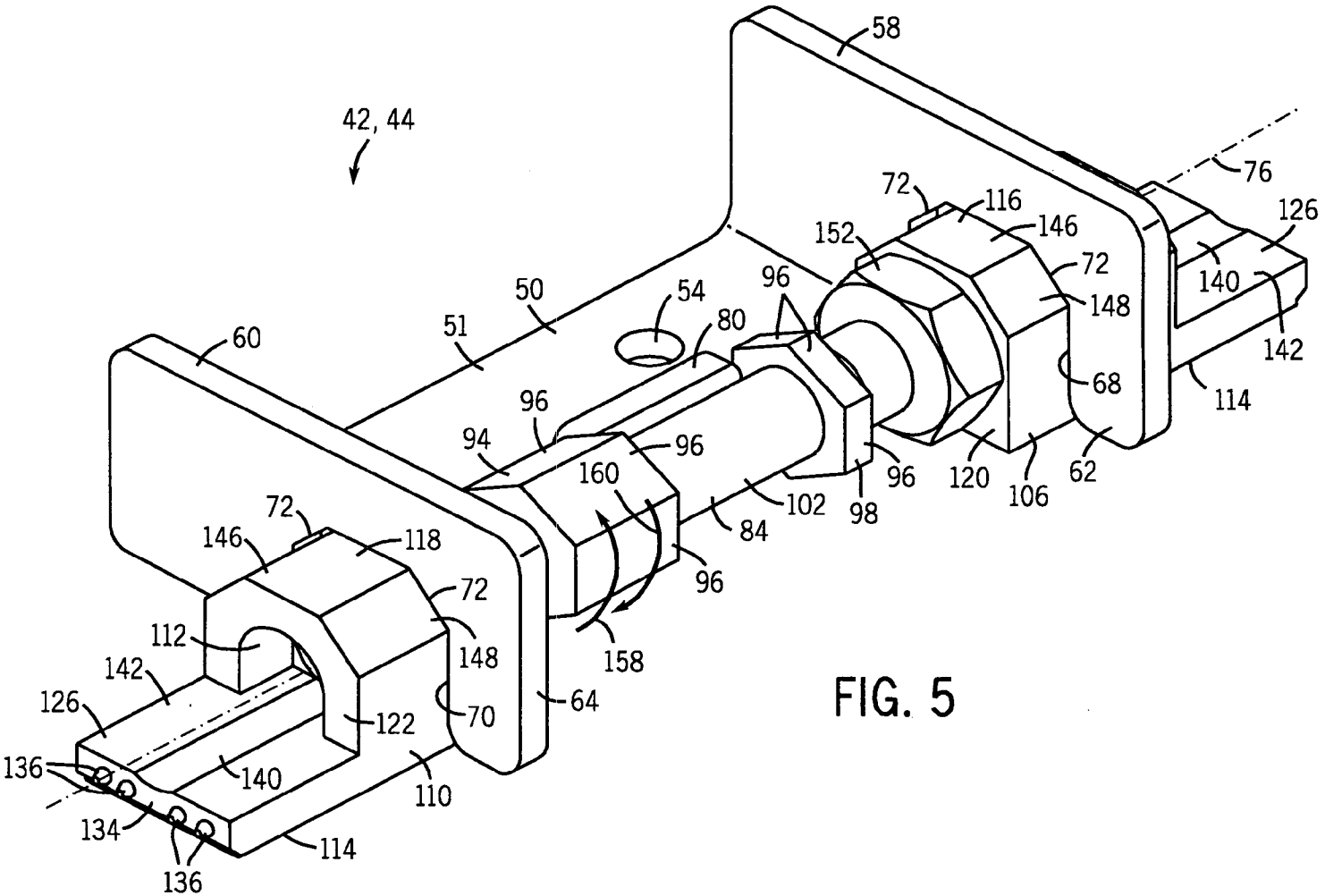
FIG. 5 is an enlarged perspective view of one of the securing mechanism of FIG. 4.

Using a wrench or another similar tool, the installer rotates the first or second operator 94, 98 in a first direction (as indicated by arrow 158; FIG. 5) about the longitudinal axis 76 to extend the first and second anchors 106, 110 laterally toward the sides 30 of the midrail 20. When the first and second anchors 106, 110 are in the extended position they exert compressive forces against the sides 30, securing the exit device 36 in the midrail 20. Additionally, the conical protrusions 136 on the lips 126 are forced into the sides 30, securing the first and second anchors 106, 110 in position and preventing the first and second anchors 106, 110 from moving laterally along the sides 30 of the midrail 20. To remove the exit device 36 from the cutout 32 or to reposition the exit device 36 in the cutout 32, the installer can retract the first and second anchors 106, 110 by rotating the first or second operator 94, 98 in a second opposite direction (indicated by arrow 160; FIG. 5).

Once the first and second anchors 106, 110 are in the extended position and the installer is satisfied that the first and second anchors 106, 110 will securely hold the exit device 36 in the cutout 32, the installer locks the securing mechanism 42 in the extended position by moving and tightening the lock nut 152 into a locked position adjacent the interior side 120 of the first anchor 106. The lock nut 152 then holds the securing mechanism 42 in the locked position and ensures that door vibrations do not loosen the securing mechanism 42.

In a similar manner, the installer secures the other end of the exit device 36 in the cutout 32 with the securing mechanism 44. Additionally, as mentioned above, additional securing mechanisms (not shown) can be positioned along the length of the exit device 36 as desired.

The embodiments described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims. The functions of the various elements and assemblies of the present invention can be changed to a significant degree without departing from the spirit and scope of the present invention.

What is claimed is:

1. A securing mechanism coupling an exit device to a midrail in a door, the securing mechanism comprising:

a shaft having a first end and a second end and defining a longitudinal axis;

a bracket coupled to the exit device, the bracket defining a first aperture and a second aperture, the first end of the shaft extending through the first aperture and the second end of the shaft extending through the second aperture;

a first anchor slideably coupled to the shaft and being moveable along the longitudinal axis between a first locked position and a first unlocked position, the first anchor frictionally engaging the midrail in the first locked position and being disengageable from the midrail in the first unlocked position; and a second anchor slideably coupled to the shaft and being moveable along the longitudinal axis between a second locked position and a second unlocked position, the second anchor frictionally engaging the midrail in the second locked position.

2. The securing mechanism of claim 1, wherein the first anchor and the second anchor are threadably coupled to the shaft.

3. The securing mechanism of claim 2, wherein the first end is threaded in a first direction and the second end is threaded in a second direction, the first direction being opposite the second direction.

4. The securing mechanism of claim 2, further comprising a threaded fastener movable along the shaft, the threaded fastener being operable to secure the first anchor in the first locked position.

5. The securing mechanism of claim 4, wherein the threaded fastener is operable to secure the second anchor in the second locked position.

6. The securing mechanism of claim 1, wherein the shaft includes at least one flat face extending longitudinally along the longitudinal axis.

7. The securing mechanism of claim 1, further comprising a shoulder extending radially from the shaft, the shoulder limiting the sliding movement of the first anchor and the second anchor along the longitudinal axis.

8. The securing mechanism of claim 1, wherein the midrail defines a recess, and wherein the exit device is positioned in the recess.

9. A securing mechanism coupling an exit device to a midrail in a door, the securing mechanism comprising:

a shaft having a first end and a second end and defining a longitudinal axis;

a bracket coupled to the exit device, the bracket defining a first aperture and a second aperture, the first end of the shaft extending through the first aperture and the second end of the shaft extending through the second aperture;

a first anchor slideably coupled to the shaft and being moveable along the longitudinal axis between a first locked position and a first unlocked position, the first anchor frictionally engaging the midrail in the first locked position and being disengageable from the midrail in the first unlocked position; and a second anchor slideably coupled to the shaft and being moveable along the longitudinal axis between a second locked position and a second unlocked position, the second anchor frictionally engaging the midrail in the second locked position;

wherein the bracket matingly engages the first and second anchors, substantially preventing the first anchor and the second anchor from rotating about the longitudinal axis with respect to the door.

10. A securing mechanism coupling an exit device to a midrail in a door, the securing mechanism comprising:

a shaft having a first end and a second end and defining a longitudinal axis;

a bracket coupled to the exit device, the bracket defining a first aperture and a second aperture, the first end of the shaft extending through the first aperture and the second end of the shaft extending through the second aperture;

a first anchor slideably coupled to the shaft and being moveable along the longitudinal axis between a first locked position and a first unlocked position, the first anchor frictionally engaging the midrail in the first locked position and being disengageable from the midrail in the first unlocked position; and a second anchor slideably coupled to the shaft and being moveable along the longitudinal axis between a second locked position and a second unlocked position, the second anchor frictionally engaging the midrail in the second locked position;

wherein the first anchor includes a first plurality of axially extending protrusions, the first plurality of axially extending protrusions inatingly engaging the midrail when the first anchor is in the first locked position.

11. The securing mechanism of claim 10, wherein the second anchor includes a second plurality of axially extending protrusions, the second plurality of axially extending protrusions matingly engaging the midrail when the second anchor is in the second locked position.

12. A securing mechanism coupling an exit device to a midrail in a door, the securing mechanism comprising:

a threaded shaft having a first end and a second end and defining a longitudinal axis;

a bracket coupled to the exit device, the bracket defining a first aperture and a second aperture, the first end extending through the first aperture and the second end extending through the second aperture;

a first anchor threadably coupled to the shaft and being moveable along the longitudinal axis; and a second anchor threadably coupled to the shaft and being moveable along the longitudinal axis, the securing mechanism having a locked condition and an unlocked condition, the first and second anchors frictionally engaging the midrail in the locked condition and being positioned toward the first and second ends respectively when the securing mechanism is in the locked condition, the first and second anchors being disengageable from the midrail in the unlocked condition.

13. The securing mechanism of claim 12, wherein the first end is threaded in a first direction and the second end is threaded in a second direction, the first direction being opposite the second direction.

14. The securing mechanism of claim 12, further comprising a threaded fastener movable along the shaft, the threaded fastener being operable to secure the securing mechanism in the locked condition.

15. The securing mechanism of claim 12, wherein the bracket prevents the first anchor from rotating about the longitudinal axis with respect to the door and the bracket prevents the second anchor from rotating about the longitudinal axis with respect to the door.

16. The securing mechanism of claim 12, wherein the shaft includes at least one flat face extending longitudinally along the longitudinal axis.

17. The securing mechanism of claim 12, further comprising a shoulder extending radially from the shaft, the shoulder limiting the sliding movement of the first anchor and the second anchor along the longitudinal axis.

18. The securing mechanism of claim 12, wherein the midrail defines a recess, and wherein the exit device is positioned in the recess.

19. A securing mechanism coupling an exit device to a midrail in a door, the securing mechanism comprising:

a threaded shaft having a first end and a second end and defining a longitudinal axis;

a bracket coupled to the exit device, the bracket defining a first aperture and a second aperture, the first end extending through the first aperture and the second end extending through the second aperture;

a first anchor threadably coupled to the shaft and being moveable along the longitudinal axis; and a second anchor threadably coupled to the shaft and being moveable along the longitudinal axis, the securing mechanism having a locked condition and an unlocked condition, the first and second anchors frictionally engaging the midrail in the locked condition and being positioned toward the first and second ends respectively when the securing mechanism is in the locked condition, the first and second anchors being disengageable from the midrail in the unlocked condition;

wherein the first anchor includes a first plurality of axially extending protrusions, the first plurality of axially extending protrusions matingly engaging the midrail when the securing mechanism is in the locked condition.

20. The securing mechanism of claim 19, wherein the second anchor includes a second plurality of axially extending protrusions, the second plurality of axially extending protrusions matingly engaging the door when the securing mechanism is in the locked condition.

21. A method of coupling an exit device to a midrail in a door with a securing mechanism, the securing mechanism including a bracket defining a first aperture and a second aperture, a threaded shaft having a first end and a second end and defining a longitudinal axis, the first end extending through the first aperture and the second end extending through the second aperture, a first anchor slideably coupled to the shaft, and a second anchor slideably coupled to the shaft, the method comprising:

coupling the bracket to the exit device;

rotating the shaft in a first direction about the longitudinal axis;

moving the first anchor along the shaft toward the first end;

moving the second anchor along the shaft toward the second end; and applying a compressive force against at least a portion of the midrail with the first and second anchors to secure the exit device and the securing mechanism to the midrail.

22. A method of coupling an exit device to a midrail in a door with a securing mechanism, the securing mechanism including a bracket defining a first aperture and a second aperture, a threaded shaft having a first end and a second end and defining a longitudinal axis, the first end extending through the first aperture and the second end extending through the second aperture, a first anchor slideably coupled to the shaft, and a second anchor slideably coupled to the shaft, the method comprising:

coupling the bracket to the exit device;

rotating the shaft in a first direction about the longitudinal axis;

moving the first anchor along the shaft toward the first end;

moving the second anchor along the shaft toward the second end; and applying a compressive force against at least a portion of the midrail with the first and second anchors to secure the exit device and the securing mechanism to the midrail;

wherein the first anchor includes a first plurality of axially extending projections and the second anchor includes a second plurality of axially extending projections and the method further comprises engaging the midrail with the first plurality of axially extending projections and the second plurality of axially extending projections.

23. The method of claim 22, wherein the shaft includes a threaded fastener movable along the shaft, the method further comprising moving the threaded fastener adjacent the first anchor to lock the securing mechanism in engagement with the door.

24. The method of claim 22, wherein the securing mechanism includes a lock, the method further comprising moving the lock along the shaft and into engagement with one of the first anchor and the second anchor to secure the securing mechanism in a locked condition, in which the first and second anchors apply a compressive force to the door to hold the exit device and the securing mechanism in the door.

25. A securing mechanism coupling an exit device to a midrail in a door, the securing mechanism comprising:

a shaft having a first end and a second end;

a bracket coupled to the exit device, the bracket defining an aperture, the shaft extending through the aperture;

an anchor slideably coupled to the shaft and being moveable along the longitudinal axis between a locked position and an unlocked position, the anchor frictionally engaging the midrail in the locked position to secure the exit device to the midrail; and a lock moveable along the shaft and being engageable with the anchor to secure the anchor in the locked position.

* * * * *